US010589903B2

(12) United States Patent
Asikainen

(10) Patent No.: US 10,589,903 B2
(45) Date of Patent: Mar. 17, 2020

(54) PACKAGE OR PRODUCT AND A PACKAGE OR PRODUCT ROLL

(71) Applicant: Koepala Packaging Oy, Helsinki (FI)

(72) Inventor: Janne Asikainen, Helsinki (FI)

(73) Assignee: Koepala Packaging Oy, Helsinki (FI)

( * ) Notice: Subject to any disclaimer, the term of this patent is extended or adjusted under 35 U.S.C. 154(b) by 0 days.

(21) Appl. No.: 15/966,550

(22) Filed: Apr. 30, 2018

(65) Prior Publication Data

US 2018/0244434 A1 Aug. 30, 2018

Related U.S. Application Data

(63) Continuation of application No. PCT/FI2016/050780, filed on Nov. 4, 2016.

(30) Foreign Application Priority Data

Nov. 6, 2015 (FI) ..... 20155817

(51) Int. Cl.
*B65D 33/00* (2006.01)
*B65D 75/00* (2006.01)
(Continued)

(52) U.S. Cl.
CPC ..... *B65D 33/002* (2013.01); *B65D 5/3685* (2013.01); *B65D 33/16* (2013.01); *B65D 75/008* (2013.01); *B65D 2575/366* (2013.01)

(58) Field of Classification Search
CPC .... B65D 33/002; B65D 5/3685; B65D 33/16; B65D 75/008
(Continued)

(56) References Cited

U.S. PATENT DOCUMENTS 2,718,105 A * 9/1955 Ferguson ..... B29C 51/445 383/104
3,031,121 A * 4/1962 Chase ..... A45C 7/0059 220/902
(Continued)

FOREIGN PATENT DOCUMENTS

CN 2332660 Y 8/1999
CN 1352613 A 6/2002
(Continued)

OTHER PUBLICATIONS

Finnish Patent Office, search report dated May 11, 2016, in FI patent application No. 20155817.
(Continued)

*Primary Examiner* — Jes F Pascua
(74) *Attorney, Agent, or Firm* — Berggren LLP

(57) ABSTRACT

The invention relates to a package or product comprising at least one space for contents or objects, formed of at least one flexible part, which is a flexible pouch type container part, and to the at least one flexible part attached at least one stiff support part, in which the at least one stiff support part forms in opened position at least part of wall structure of the package or product. The at least one flexible part and the at least one stiff support part form the at least one space for the objects or contents, when the stiff material of the support part is bent and/or the package is opened at the stiff support part. The invention also relates to a package or product roll.

5 Claims, 10 Drawing Sheets

(51) Int. Cl.
*B65D 33/16* (2006.01)
*B65D 5/36* (2006.01)

(58) Field of Classification Search
USPC ..... 383/2, 4, 66, 104, 37, 38, 39
See application file for complete search history.

(56) References Cited

U.S. PATENT DOCUMENTS

| | | | | |
|---|---|---|---|---|
| 3,640,381 | A * | 2/1972 | Kanada | B65D 33/02 229/117.31 |
| 4,584,101 | A * | 4/1986 | Kataoka | B65D 85/8043 210/474 |
| 5,551,781 | A | 9/1996 | Wilkes et al. | |
| 8,875,478 | B2 * | 11/2014 | Fitzgerald, IV | B65B 9/08 53/450 |
| 2004/0022457 | A1 | 2/2004 | Brown et al. | |
| 2012/0048860 | A1 | 3/2012 | Bar et al. | |
| 2012/0210879 | A1 | 8/2012 | Mariller | |

FOREIGN PATENT DOCUMENTS

| | | | |
|---|---|---|---|
| CN | 101119897 | A | 2/2008 |
| CN | 104603016 | A | 5/2015 |
| DE | 2511187 | A1 | 9/1975 |
| DE | 7833490 | U1 | 2/1981 |
| DE | 202011109209 | U1 | 7/2012 |
| EP | 0178918 | A2 | 4/1986 |
| EP | 2511187 | A2 | 10/2012 |
| WO | 0125112 | A1 | 4/2001 |
| WO | 2011032144 | A2 | 3/2011 |

OTHER PUBLICATIONS

Chinese Patent Office, Office Action issued in CN patent application No. 2016800644557 dated Mar. 18, 2019, Search Report 2 pages.

* cited by examiner

PACKAGE OR PRODUCT AND A PACKAGE OR PRODUCT ROLL

PRIORITY

This application is continuation application of international application number PCT/FI2016/050780 filed on 4 Nov. 2016, which claims priority of Finnish national application number 20155817 filed on Nov. 6, 2015, the content of both of which is incorporated herein by reference.

TECHNICAL FIELD

The invention relates to packages for objects or to products, in particular the invention relates to packaging technology. Particularly the invention relates to packages for bulk type products, especially for foodstuffs, and liquids, especially for beverages. More particularly the invention relates to a package or a product comprising a non-opened position and an opened position, in which opened position the package or product comprises at least one expanded space for contents or objects, which at least one expanded space is formed of at least one flexible part, which is a flexible pouch type container part, and in which package or product to the at least one flexible part is attached at least one stiff support part, in which package or product the at least one stiff support part forms in the opened position at least part of wall structure of the package or product, which package or product further comprises at least one opening point, in which package or product the at least one flexible part and the at least one stiff support part form the at least one expanded space for the objects or contents and the at least one flexible part is fitted to form the expanded space for the objects or contents adapting to the support structure formed by the at least one stiff support part, and which package or product is self-standing, and to a package roll or a product roll according to package or product roll comprising several packages or products.

BACKGROUND

Prior art discloses many types of packages for bulk type products and liquids, especially for foodstuffs and beverages. In publication WO2014067673 is disclosed a reclosable flow pack, which has a seal that is openable on the top part made of flexible material. In publication EP1714892 is disclosed a packing bag for beverages made of a shape-stable packing material. In publication WO9008708 is disclosed band-form packaging material suitable for fabricating a pouch type package which is at least partly gas-permeable and at least partly transparent, in which the transparent part is formed of a transparent plastic band located on side surface of the pouch type package. In publication JP2007099327 is disclosed a food packaging item which is a pouch type packaging item made of flexible film material and which is openable from one side by opening a seal in order to widely expose its content out of it. In publication JP2014015231 is disclosed a packaging bag made of film for storing and serving food, which comprises a wall structure for placing the bag to a standing position and keeping the shape of the bag substantially the same during storing and serving. In publication WO2014204465 is disclosed a self-forming container having a stable base connected to and supporting side wall structure, which container is in form of a pouch and openable from side. In publication U.S. Pat. No. 3,147,674 is disclosed a method for making bags, in which an adhesive band is used for closing the bags. In WO2011032144 is disclosed a microwave popcorn package comprising a sidewall construction defining an interior, the side-wall construction formed of a vertically rigid material and configured to be expandable between a collapsed configuration and an expanded configuration; and a flexible bag construction having a portion secured to the interior of the sidewall construction, the flexible bag construction configured to be expandable between the collapsed configuration and the expanded configuration, wherein the flexible bag construction and the sidewall construction form a container having vertically rigid sidewalls in the expanded configuration. In DE7833490 U1 is disclosed a foldable drinking vessel with a bottom part of foil material. In EP2511187 is disclosed a container for packaging filling materials, in particular a bag or pouch made of plastic film.

SUMMARY

An object of the invention is to create a new type of package or product of pouch type, in which the disadvantages and problems of prior art are eliminated or at least minimized.

An object of the invention is to provide a new type of package for bulk type products and liquids, in which disadvantages especially relating to storing empty packages before use are eliminated or at least minimized.

An object of the invention is to provide a new type of package for bulk type products and liquids, in which disadvantages especially relating to transporting the filled package before serving or use of the contents are solved.

In particular an object of the invention is to provide a new type of package of pouch type, which is suitable for storing and serving foodstuffs and beverages.

It is an object of this invention to provide the package or product comprising a non-opened position and an opened position, in which opened position the package or product comprises at least one expanded space for contents or objects, which at least one expanded space is formed of at least one flexible part, which is a flexible pouch type container part, and in which package or product to the at least one flexible part is attached at least one stiff support part, in which package or product the at least one stiff support part forms in the opened position at least part of wall structure of the package or product, which package or product further comprises at least one opening point, in which package or product the at least one flexible part and the at least one stiff support part form the at least one expanded space for the objects or contents and the at least one flexible part is fitted to form the expanded space for the objects or contents adapting to the support structure formed by the at least one stiff support part, and which package or product is self-standing, wherein the at least one expanded space for the objects or contents is fitted to be formed, when the stiff material of the stiff support part is bent and the package or product is opened at the stiff support part or when the package or product is opened at the stiff support part, that the at least one opening point is fitted to set the at least one stiff support part to form a supporting structure for the expanded space and the shape of the expanded space in the opened position of the package or product.

It is another object of this invention to provide the package roll is formed of a wound web comprising several sequentially located packages or products According to the invention the package or the product comprises at least one space for contents or objects, formed of at least one flexible part, which is a flexible pouch type container part, and to the at least one flexible part attached at least one stiff support part, in which the at least one stiff support part forms in opened position at least part of wall structure of package, wherein the at least one flexible part and the at least one stiff support part form the at least one space for the objects or contents, when the stiff material of the support part is bent and/or the package is opened at the stiff support part.

According to the invention the package or product further comprises at least one opening point, which when expanded is fitted to set the at least one stiff support part to form a supporting structure for the space and the shape of the space and that the at least one flexible part is fitted to form the space for the objects or contents adapting to the support structure formed by the at least one stiff support part.

The stiff support part can be made of sheet-like material comprising one layer stiff material or comprising more than one layers of material, which layers folded, combined or attached on top of each other form layered material of the stiff support part. The stiff support part and the flexible part can be releasably attached to each other and the stiff support part can be attached to the flexible part even after the space has been filled with contents or objects.

According to the invention the package is self-standing.

According to an advantageous feature of the invention in non-opened position the package is planar and pouch-like and in opened position the package is three-dimensional having a substantially depth directional dimension.

According to an advantageous feature of the invention on the stiff support part are located creases such as bend lines, cut lines, cut outs and/or tear lines for opening the package and/or for forming the space for the objects.

According to an advantageous feature of the invention the package is a pouch formed of two sheets, which are placed one on the other and attached together. Depending on the production method the two sheets may be formed to one material web attached together for example by laminating, which material web is bent to form the pouch or when the different materials are attached to each other at the edges by seals the material is bent hingedly to be sealed.

According to an advantageous feature of the invention the package is formed of one sheet like material by folding technique such that for the stiff support part several layers of material are folded on top of each other and for the flexible part one layer of material is used.

According to an advantageous feature of the invention the package comprises at the opening point attached closure means, by pulling of which closure means the package is openable. The closure means can be located in the stiff support part or in the flexible part or extending to both the stiff support part and the flexible part. In one package or product there may be one or more closure means.

According to an advantageous feature of the invention the closure means is reclosable.

According to the invention the package or product roll comprises several packages or products and the package roll is formed of a wound web comprising several sequentially located packages or products.

According to an advantageous feature of the invention between two successive packages in the package roll a tear line is located and in which closure means extend on the web from one package to next.

The method for producing packages comprises a step of attaching a flexible part and a stiff support part of the package to each other by sealing or adhering them to each other at the edge area, in which method the packages are produced in the line several package blanks sequentially located in a web-like form, in which the blanks are limited by a tear crease or by a corresponding line, wherein creases on the stiff support part are formed and closure means for an opening point of the package is added.

The method is advantageously a flow-pack-method or a side-seal-method or a thermoforming-method.

The package or product according to the invention is for storing and taking for using or to serving or taking up objects, especially bulk stuffs and items and more especially for foodstuffs and beverages. Advantageously additionally the package is suitable for transporting and/or moving objects (bulk stuffs and items).

Thus according to the invention the package or product has at least one space, a container for the objects, which space is needed when storing and/or taking up and/or taking the objects i.e. contents inside the container. The package is formed of a flexible pouch type container part and to the container attached, advantageously laminated, at least one support part of stiff material. The at least one stiff support part forms in when opened at least part of wall structure of a self-standing package. In the package the flexible part and the at least one stiff support part together form the at least one space for the objects when the stiff material of the support part is bent and/or the package is opened at the stiff material. There is at least one opening point, which when expanded is fitted to set the at least one stiff support part to form a supporting structure for the space and thus the form of the space and simultaneously the flexible part is fitted to form the space for the objects adapting to the support structure formed by the at least one stiff support part.

Advantageously in non-opened position the package is planar and pouch-like and in opened position the package is three-dimensional having also a substantially depth directional dimension.

According to an advantageous feature of the invention the package is bendable or rollable to a vertical form, to a beverage can-form, wherein on one side of the package a punchable hole is provided for a straw, which one side is in the can-form in top part of the can.

According to an advantageous feature of the invention at the opening point a closure means is attached, by pulling of which closure means the package is openable and by pressing back onto the surface of the package the package is closable.

According to an advantageous feature of the invention before the stage of taking the packages to use the packages are located sequentially (and additionally parallel) forming a package web, which web may be wound to a roll, wherein the closure means for the opening points are advantageously located extending from one package to next and forming a continuous structure.

According to an advantageous feature of the invention the package is a takeaway-package for foodstuffs and beverages. The package is suitable for storing, transporting and serving the foodstuff or the beverage.

According to an advantageous feature of the invention the package is a pouch formed of two sheets that are placed one on the other and they are attached together, for example at the edges by seals and one of the sheets is of flexible material and one of the sheets is of stiff material. Advantageously the flexible material is plastic material or cloth or paper or other fiber-type material and the stiff material is board or corresponding fiber material or stiff plastic material.

According to the invention the package roll is formed of a wound web comprising several sequentially located packages, in which between two successive packages a tear line is located and in which the closure means extend on the web from one package to next and is provided with a tear point at the location of the tear line between the packages. This provides for many advantages, small space requirements, easy to use and easy to production. The package roll can be mounted to a frame such that single packages are easy to release.

The method for producing the packages comprises a step of attaching the flexible part and the stiff support part of the package to each other by sealing or adhering them to each other at the edge area in a production line and the packages are produced in the line several package blanks sequentially located, possibly also parallel located, in a web-like form, in which the blanks are limited by a tear crease or by a corresponding line. Advantageously in the method the creases for the stiff support part are formed and the closure means for opening point of the package is added.

The method for producing the packages advantageously comprises the sealing process, in which the package formed of the flexible material and the stiff material combination and provided with necessary creases is sealed to a pouch-like form and wound to a package roll.

The method advantageously comprises recycling of used packages, cleaning of the packages, closing of the packages and attaching the packages by the closure means of the opening point to form a web for re-use of the packages.

According to the method the objects or contents can be placed inside the package in the production line or manually or by semiautomatic devices in connection with the production line or at a later stage after the producing of the package or product in the production line manually, automatically or semi-automatically.

It should be noted that in this description and the claims the term package is used but the package can also be a product in itself, which is clear from the following application examples. The package according to the invention is suitable for example:

- as a package for foodstuffs, (f. ex. baby foods, camping foods, convenience foods, takeaway-foods, self-service-foods, snacks, candies, beverages, smoothies, soups, sauces, casseroles, salads)
- as a package for small parts, assembly parts of toys etc. (toys, games, machine and device parts, spare parts, bolts and screws, hospital supplies etc.)
- as a package for chemicals in liquid form (f. ex. oils, lubricants, paints, cleaning products, hygiene products, beauty products, medical products)
- as a decorative product for houses (laundry baskets, storage products, baby cradles, travel beds etc.)
- as a transport, storage and carrying means for items (back bags, carrycots, training bags etc.)
- as means for sport and free-time products (f. ex. foldable skiing equipment, sleds)

The package according to the invention is well suitable for storing its contents as well as using the contents and for transporting in between the storing and the usage. The using of the content, for example eating or serving foodstuff from the package is easy as the package is rigid in its use position. Advantageously the package according to the invention is a new type takeaway-package for food-stuffs, for storing, transporting and serving of then, wherein the most important advantages are the easy transportation and serving as well as easy meal having.

The package according to the invention and its advantageous features comprises a flexible pouch-like container and to it attached, advantageously laminated, at least one support part of stiff material, which together provide at least one space or container for the content or objects, for example a serving-dish for foodstuffs, when the stiff support part is bent and/or the package is opened at the stiff support part. The package has at least one opening point in the stiff support part, which opening point when expanding is fitted to set the stiff support part to form a support structure for the container or space and thus to form the configuration of the space. The flexible part is fitted to form the space for the contents or objects adapting to the configuration formed by the stiff support part. The stiff support part may also comprise at least two next to each other located stiff support parts with a flexible part in between of them. Advantageously the at least one stiff support part forms in open position side walls of the container. In non-opened position the package is pouch-like and planar providing a flat, continuous piece. In opened position the support part of stiff material converts to different position and forms the walls of the piece while the flexible part remains unbroken adapting to the configuration of the stiff support part. Thus the package has a depth direction dimension and a space for the content or objects. In opened position the package is a self-standing structure. The opening point at the stiff support part may also comprise a re-closable closure means, for example detachable an adhesive material, by removing of which the package can be opened and bent to its use form. The stiff support part may also comprise creases for folding, cutting and/or tearing and for easier configuring the form for the container space.

Due to the many different application possibilities of the present invention it is clear that the material of the flexible part and the material of the stiff support part can be selected from various possibilities.

Advantageously the material of the flexible part is plastic or cloth or paper or other fiber-type material and the material of the stiff support part is board or corresponding fiber material or stiff plastic material.

In the following the invention is explained in detail with reference to the accompanying drawing to which the invention is not to be narrowly limited.

DETAILED DESCRIPTION

Figure 1A:
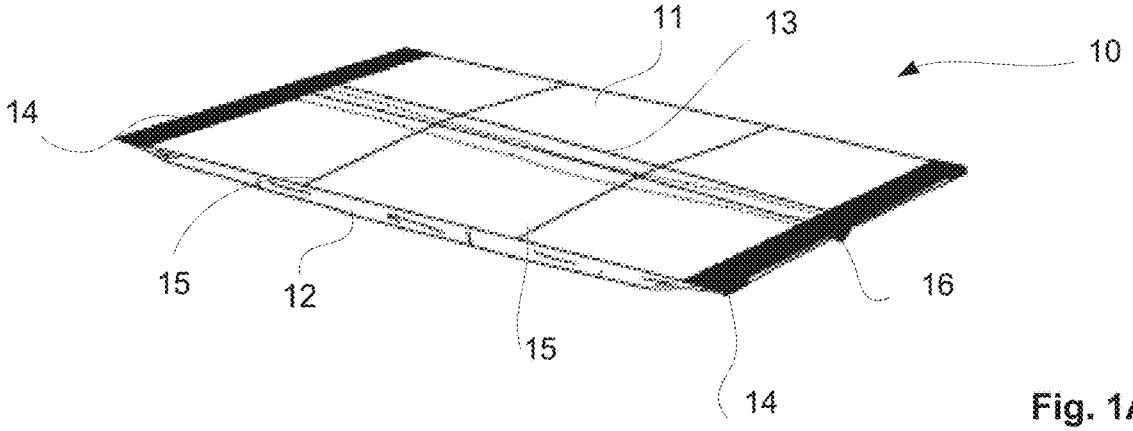
In FIGS. 1A-1C is shown schematically an advantageous example of a package, in particular for foodstuffs, according to the invention.

During the course of the following description like numbers and signs will be used to identify like elements according to the different views which illustrate the invention and its advantageous examples. In some figures repetition of the reference signs may have been omitted for clarity reasons. In FIGS. 1A-4C are illustrated examples of the invention such that in one series (1A-1C, 2A-2C, 3A-3C) figures A show an unfilled package example in unfilled stage, figures B show a filled package example during opening stage and figures C show a package in opened staged. For each opening possibility the package may comprise one or more creases for bending or the package may be bendable without creases. The space for contents or objects may vary depending on the production process of the package even though the seals and outer dimensions of the pouch would be the same.

In the examples of FIGS. 1A-9 the package 10 for storing and taking for using or to serving or taking up objects, especially bulk stuffs and items and more especially for foodstuffs and beverages and additionally for transporting and/or moving objects (bulk stuffs and items) has at least one space, a container for the objects, which space is needed when storing and/or taking up and/or taking the objects i.e. contents inside the container. The package 10 is formed of a flexible part 12, which is a flexible pouch type container part 12 and to the flexible part 12 attached, advantageously laminated, at least one support part 11 of stiff material. The at least one stiff support part 11 forms in when opened at least part of wall structure of a self-standing package 10. The flexible part 12 and the at least one stiff support part 11 together form the at least one space for the objects, when the stiff material of the support part 11 is bent and/or the package 10 is opened at the stiff material 11. There is at least one opening point 16, which when expanded is fitted to set the at least one stiff support part 11 to form a supporting structure for the space and thus the form of the space and simultaneously the flexible part 12 is fitted to form the space for the objects adapting to the support structure formed by the at least one stiff support part 11. In non-opened position, figures A the package 10 is planar and pouch-like and in opened position the package 10 is three-dimensional having also a substantially depth directional dimension. On the stiff support part 11 are located different types of creases 15 such as bend lines, cut lines, cut outs and/or tear lines for opening the package 10 and/or for forming the space for the objects. The package 10 is a pouch formed of two sheets 11, 12 that are placed one on the other and they are attached together for example at the edges by seals 14 and one of the sheets 12 is of flexible material and one of the sheets 11 is of stiff material. Advantageously the flexible material is plastic material or cloth or paper or other fiber-type material and the stiff material is board or corresponding fiber material or stiff plastic material.

Figure 1B:
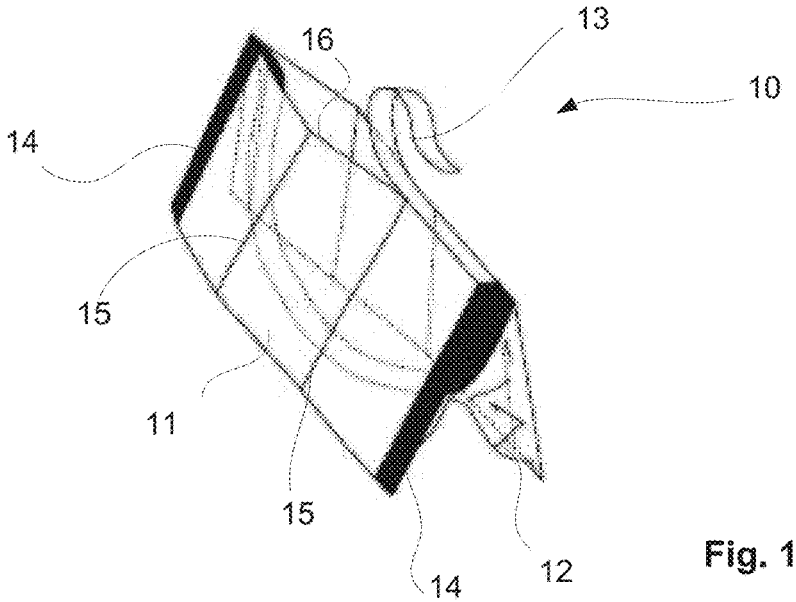

Advantageously, at the opening point 16 a closure means 13 is attached, by pulling of which closure means the package 10 is openable, as shown in FIGS. 1A-1B, and by pressing it back onto the surface of the package 10 the package 10 is closable.

As shown in the examples of FIGS. 2C, 3C, 4C, 5, 6 the package 10 is bendable or rollable to a vertical form to a beverage can-form, wherein on one side of the package a punchable hole 17 is provided for a straw, which one side is in the can-form in top part of the can.

Thus the package 10 comprises a flexible pouch-like container i.e. flexible part 12 and to it attached, advantageously laminated, at least one support part 11 of stiff material, which together provide at least one space or container for the content/objects, when the stiff support part 11 is bent and/or the package 10 is opened at the stiff support part 11. The package 10 has at least one opening point 16 in the stiff support part 11, which opening point 16 when expanding is fitted to set the stiff support part 11 to form a support structure for the container or space and thus to form the configuration of the space. The flexible part 11 is fitted to form the space for the contents or objects adapting to the configuration formed by the stiff part 11. The stiff part 11 may also comprise at least two next to each other located stiff parts with a flexible part in between of them. The stiff support part can be made of sheet-like material comprising one layer stiff material or comprising more than one layers of material, which layers folded, combined or attached on top of each other form layered material of the stiff support part. Advantageously the at least one stiff support part 11 forms in open position side walls of the package 10. In non-opened position the package 10 is pouch-like and planar providing a flat, continuous piece. In opened position the support part 11 of stiff material converts to different position and forms the outer walls of the package 10 while the flexible part 12 remains unbroken adapting to the configuration of the stiff support part 11. The opening point at the stiff support part may also comprise a re-closable closure means 13, for example detachable an adhesive material, by removing of which the package 10 can be opened and then bent to its use form. The package 10 may comprise more than one opening point with advantageously re-closable closure means. The stiff support part 11 may also comprise creases 15 for folding, cutting and/or tearing and for easier configuring the form for the container space. The package 10 may comprise seals 14 that can be used to fasten free edges of the stiff support part 11.

In FIGS. 1A-1C, 2A-2C and 3A-3C is shown three different examples of opening the package 10 from the pouch-like form, figures A, to the opened position, for serving or use etc., figures C. In figures B is shown the package 10 during opening.

Figure 1C:
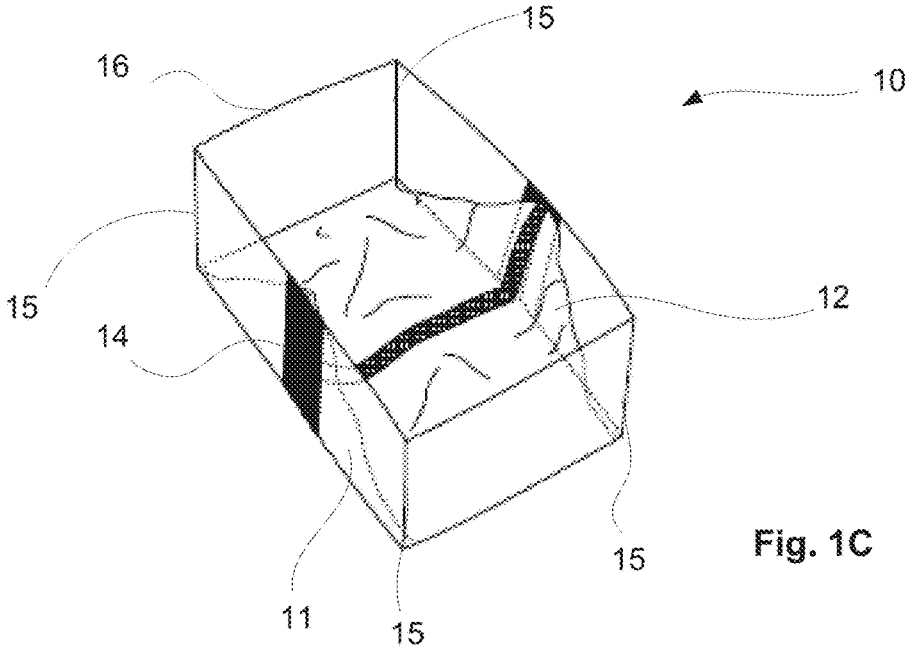

In FIGS. 1A-1C the pouch-like unopened package 10 is opened to a rectangular box-like shape. The package 10 comprises the flexible part 12 and the stiff support part 11 with creases 15 for bending. On the stiff support part 12 the opening point 16 with closure means 13 is located. The flexible part 12 and the stiff support part 11 are attached together by seals 14. As shown in FIG. 1B during opening the closure means 13 is removed and the opening point 16 is opened and expanded such that the stiff support part 11 during bending forms the outer wall structure of the package 10 and the flexible part 12 remains inside the outer wall structure.

Figure 2A:
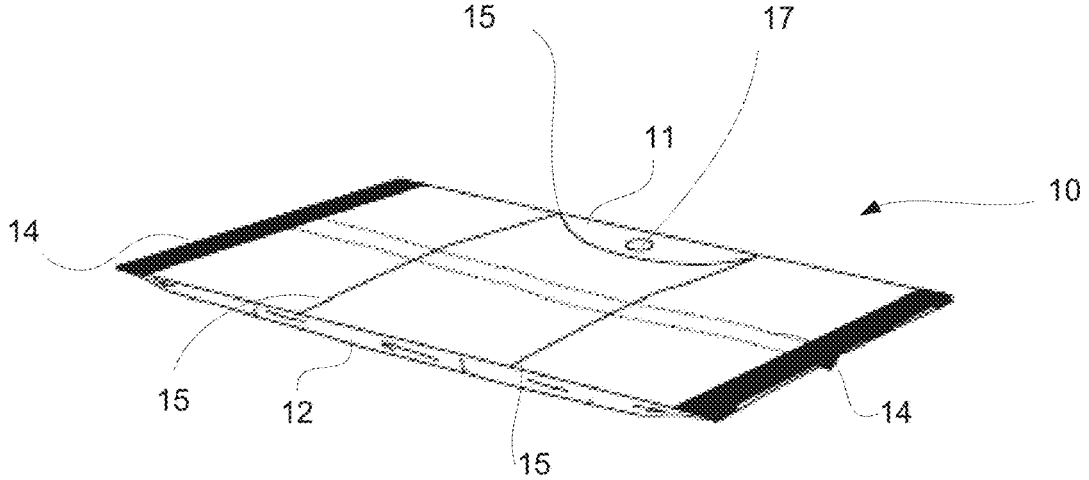
In FIGS. 2A-2C is shown schematically an advantageous example of a package, in particular for beverages, according to the invention.
Figure 2B:
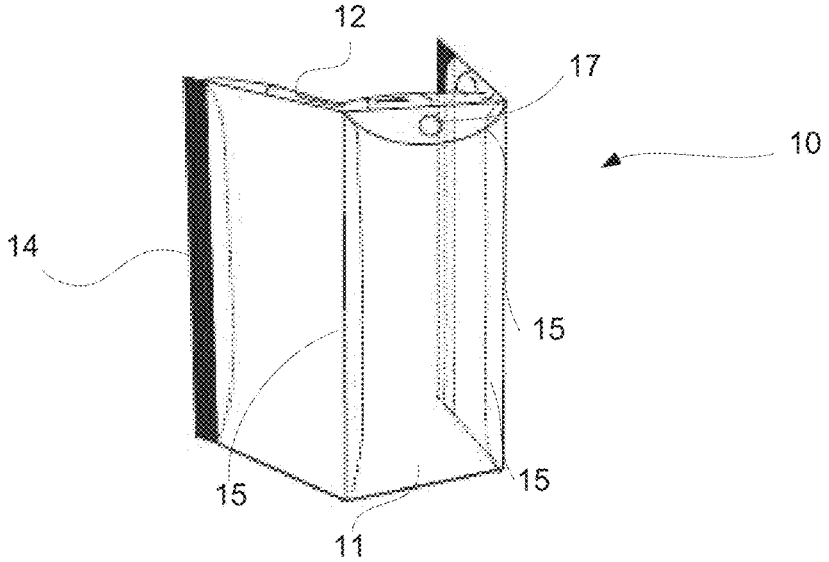
Figure 2C:
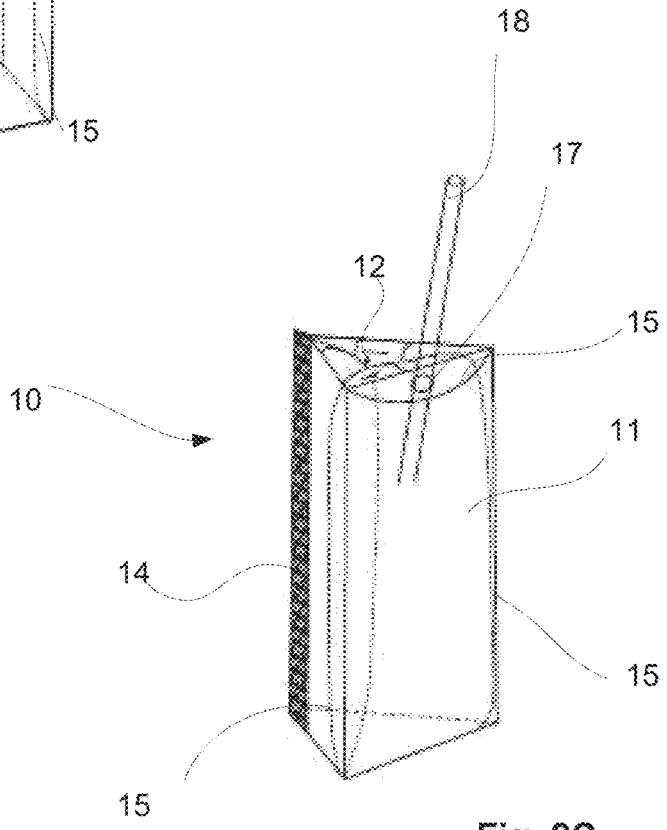

In FIGS. 2A-2C the pouch-like unopened package 10 is opened to a triangular can-like shape. The package 10 comprises the flexible part 12 and the stiff support part 11 with creases 15 for bending and an opening point 17 for a straw 18. The flexible part 12 and the stiff support part 11 are attached together by seals 14. As shown in FIG. 2B the stiff support part 11 during bending forms the outer wall structure of the package 10 and the flexible part 12 remains inside the outer wall structure.

Figure 3A:
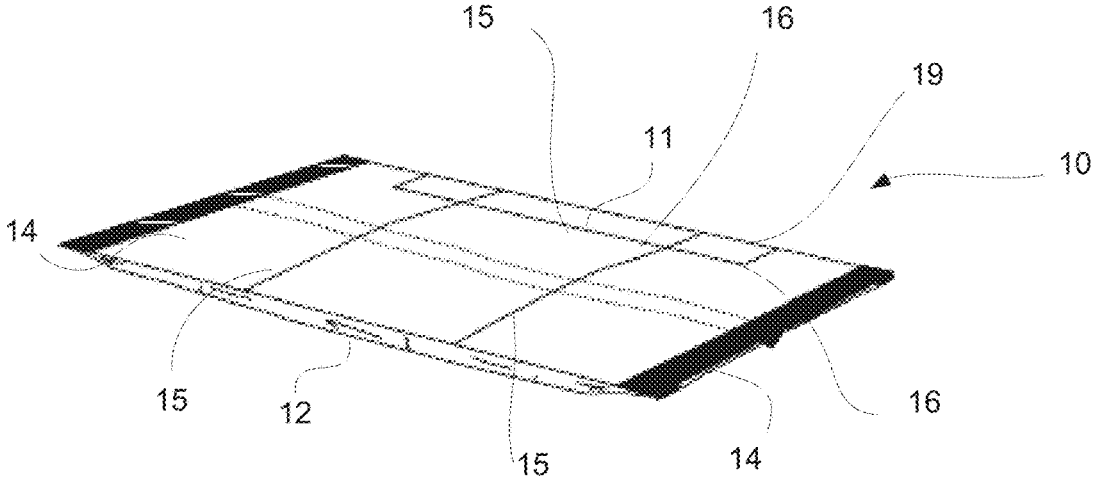
In FIGS. 3A-3C is shown schematically an advantageous example of a package, in particular for foodstuffs, according to the invention.
Figure 3B:
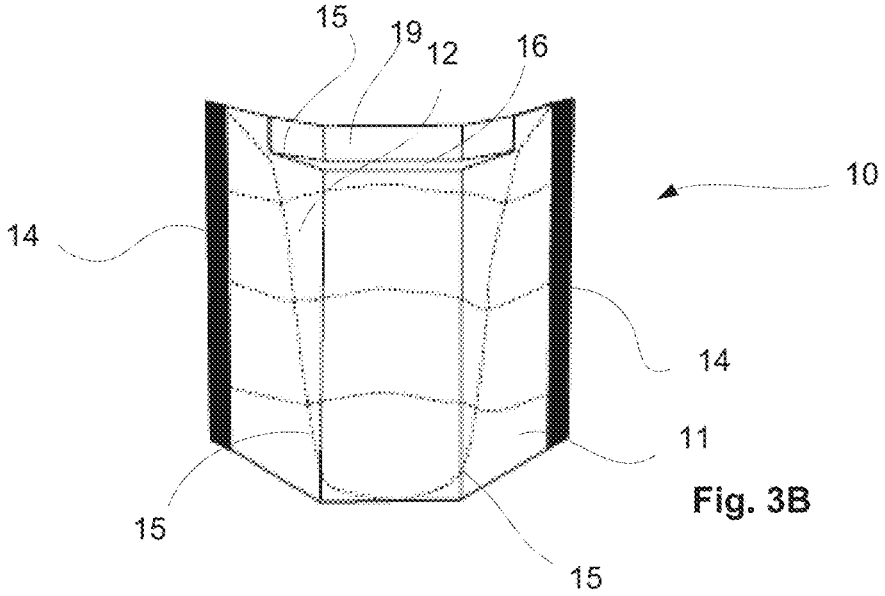
Figure 3C:
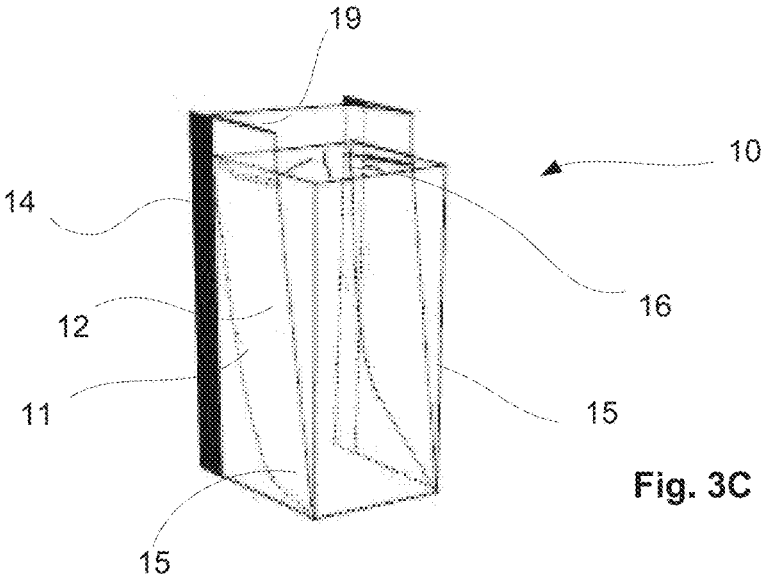

In FIGS. 3A-3C the pouch-like unopened package 10 is opened to a rectangular can-like shape. The package 10 comprises the flexible part 12 and the stiff support part 11 with creases 15 for bending and an opening point 16 near the upper edge forming top edge wall 19. The flexible part 12 and the stiff support part 11 are attached together by seals 14. As shown in FIG. 3B the stiff support part 11 during bending forms the outer wall structure of the package 10 and the flexible part 12 remains inside the outer wall structure.

Figure 4A:
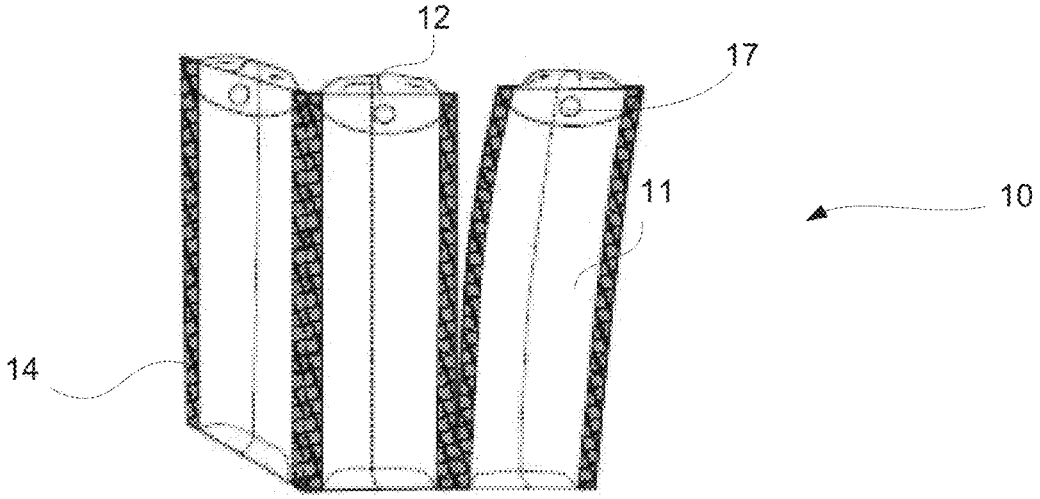
In FIGS. 4A-4C is shown schematically an advantageous example of a package, in particular for beverages, according to the invention.
Figure 4B:
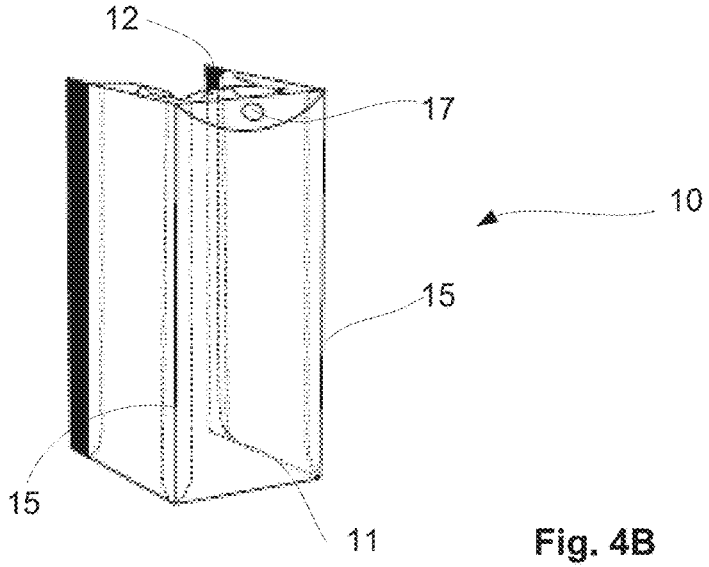
Figure 4C:
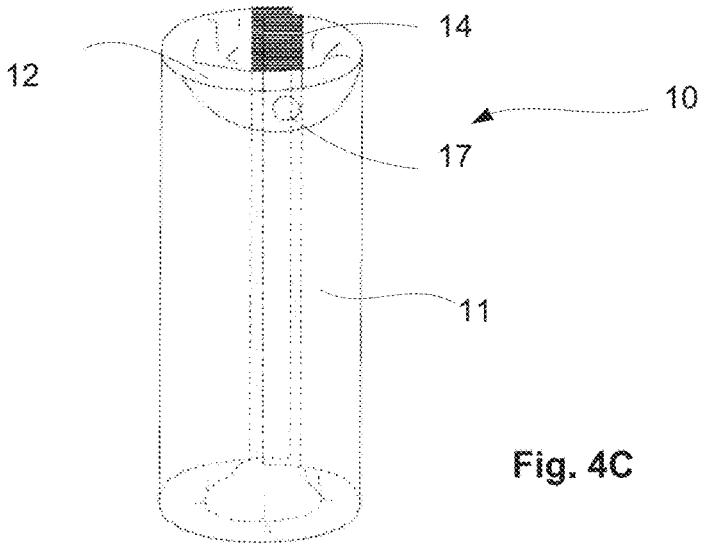

In FIG. 4A is shown an example, in which the package 10 comprises separately by seals 14 sealed pockets. The package 10 may be bent to rectangular shape, FIG. 4B, or to cylinder form, FIG. 4C.

Figure 5:
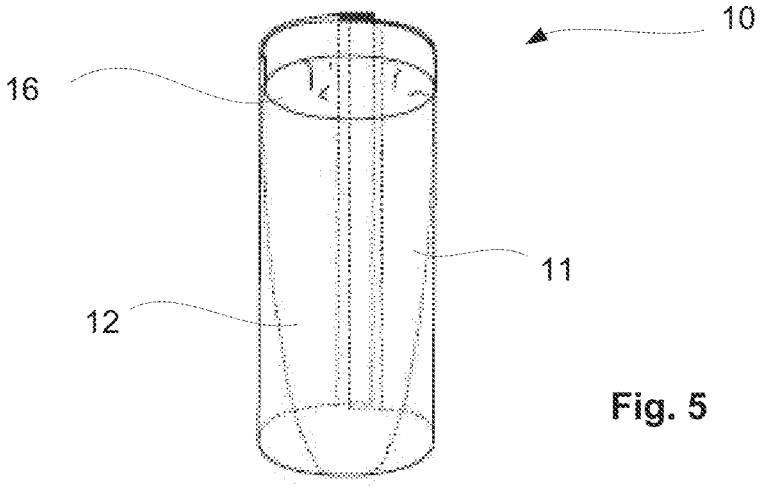
In FIGS. 5-9 are shown schematically advantageous examples of packages according to the invention.
Figure 6:
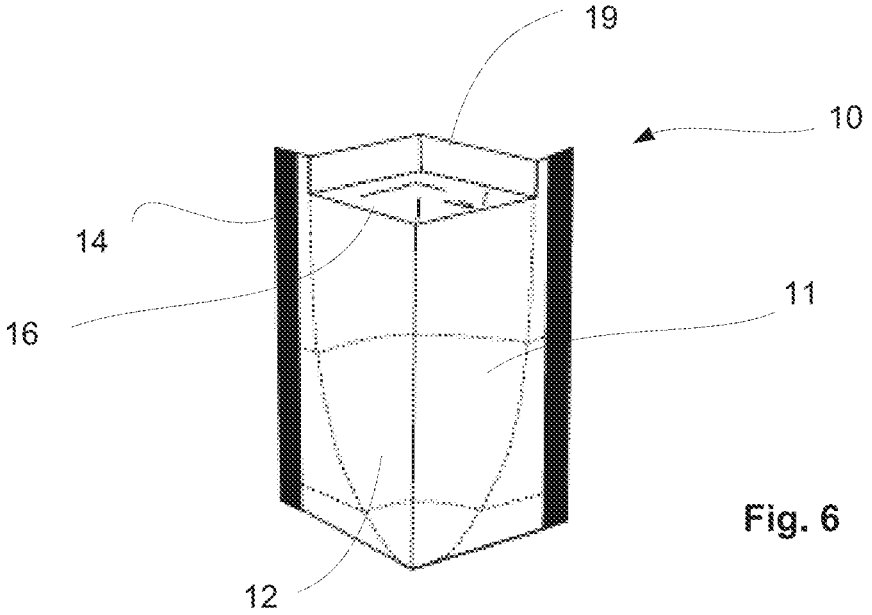

In FIGS. 5-6 are shown further examples; in FIG. 5 a cylinder shaped package 10 and in FIG. 6 a rectangular form package 10.

Figure 7:
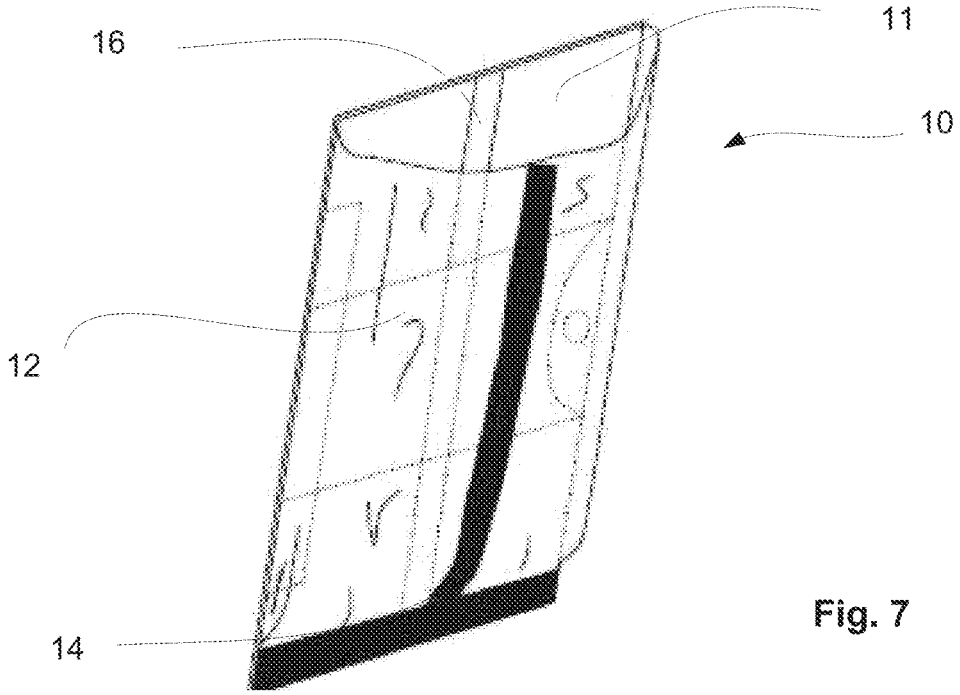
Figure 8:
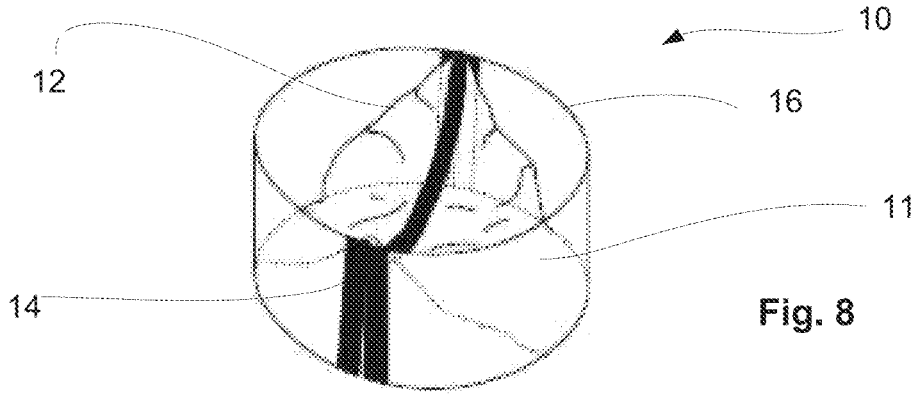
Figure 9:
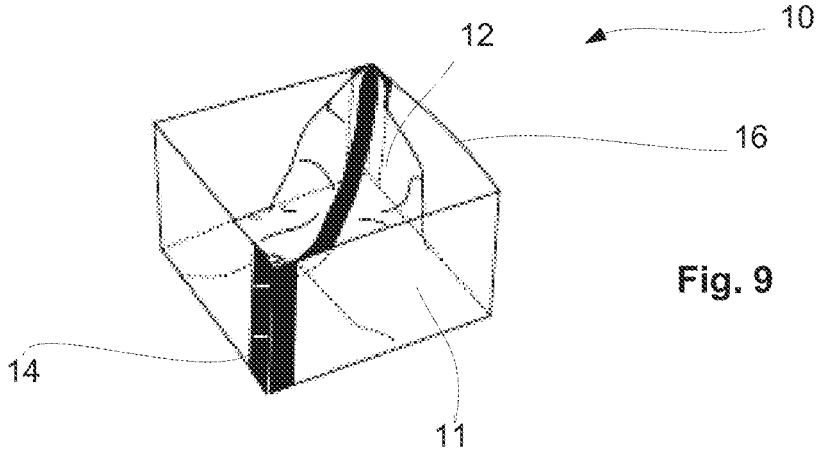

In FIGS. 7-9 are shown further examples: in FIG. 7 is shown the package 10 in the pouch-like form with one edge opened for filling, which package 10 can be opened to a cylindrical bowl-like form, FIG. 8, and to a rectangular bowl-like form, FIG. 9.

As shown in the examples of the FIGS. 1A-6 in bending and opening the package 10 one or more creases located in the stiff support part 11 can be utilized and thus the bending and/or opening point can be located in various ways based on size, location and opening manner. Additionally the package can be bent and opened without creases, wherein bendability of the stiff support part 11 and the location, size and opening manner of the opening point 16, 17 is utilized.

Figure 10:
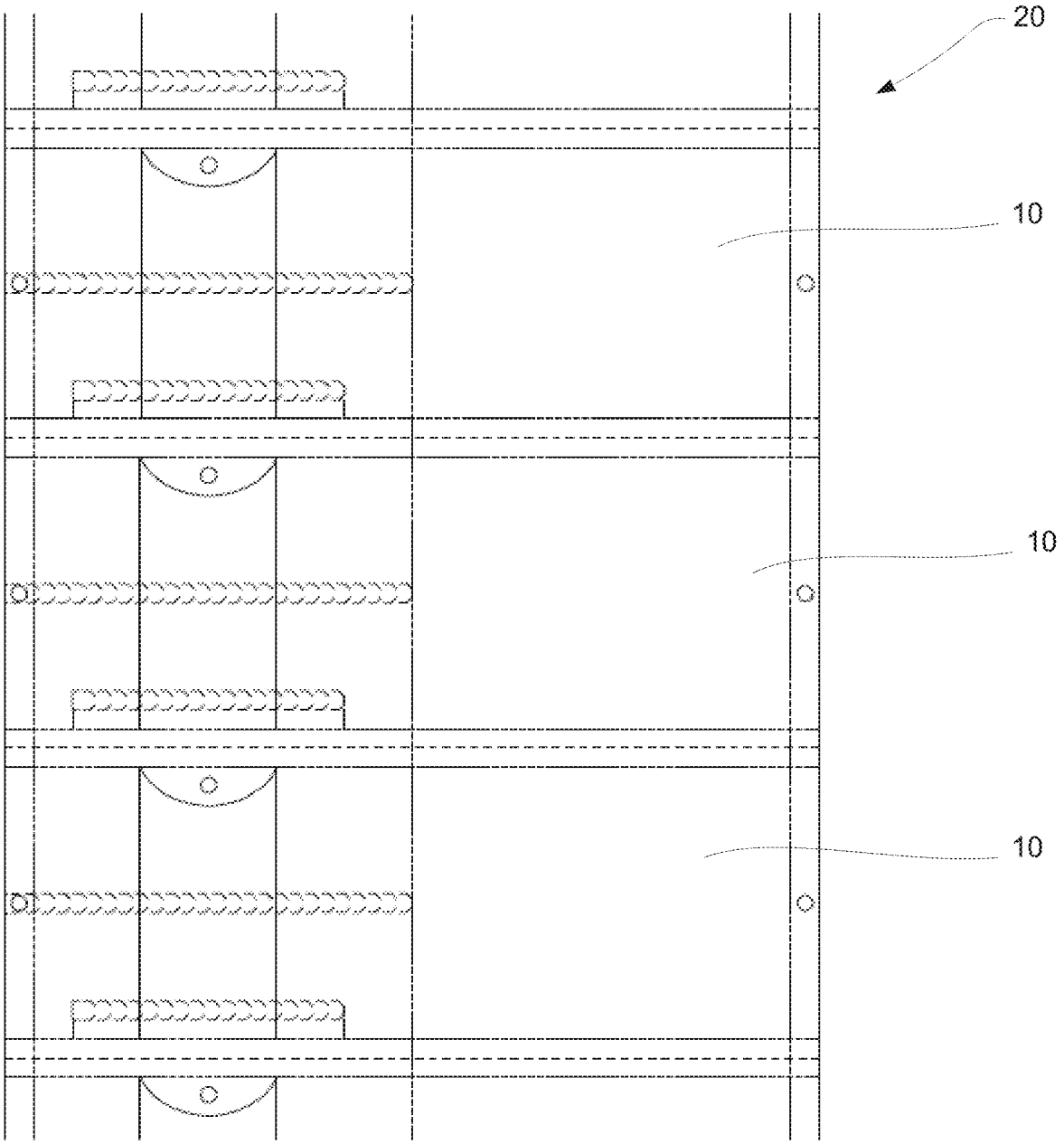
In FIGS. 10-12 are shown schematically advantageous examples of production lines for packages according to the invention.
Figure 11:
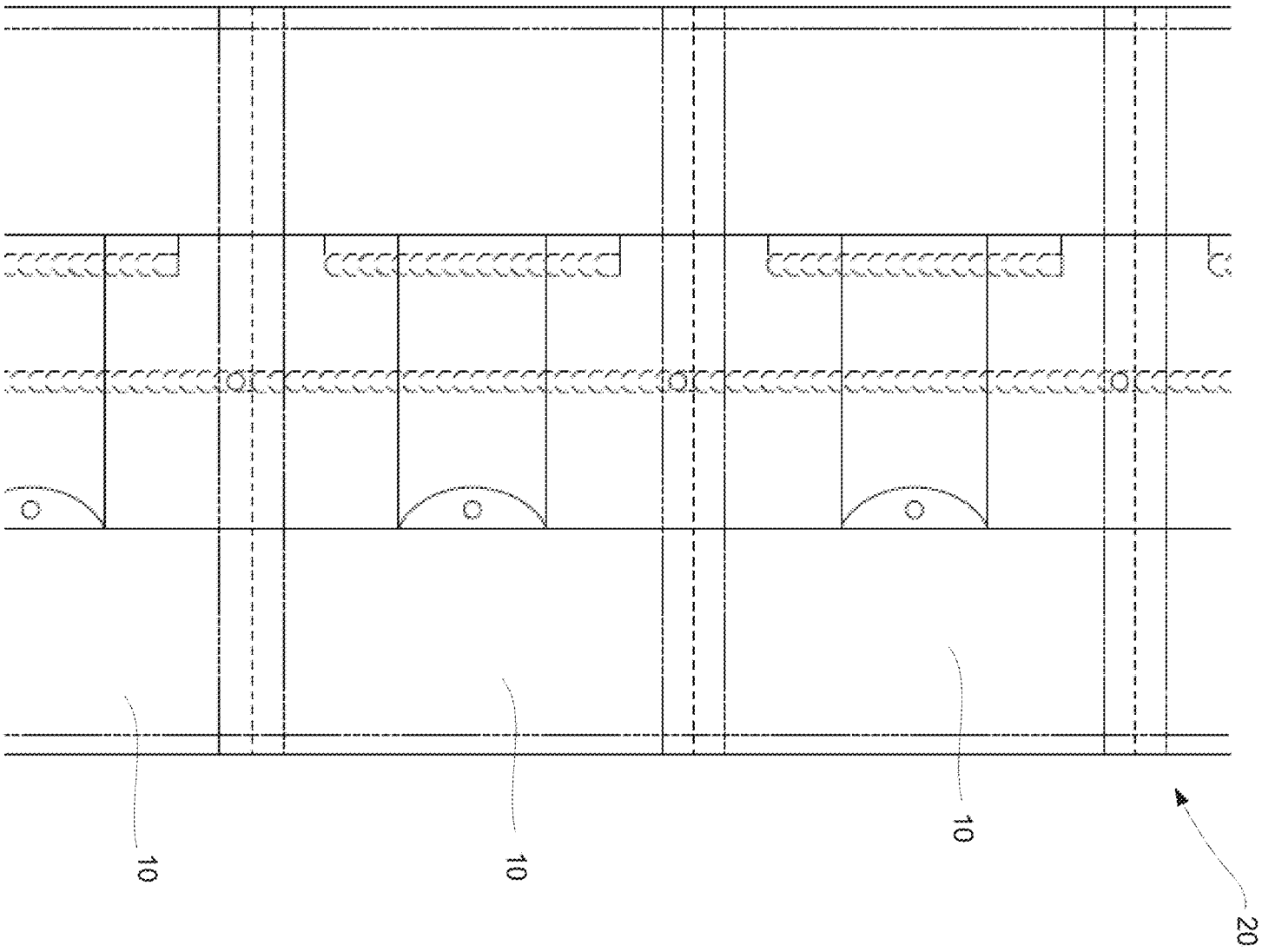
Figure 12:
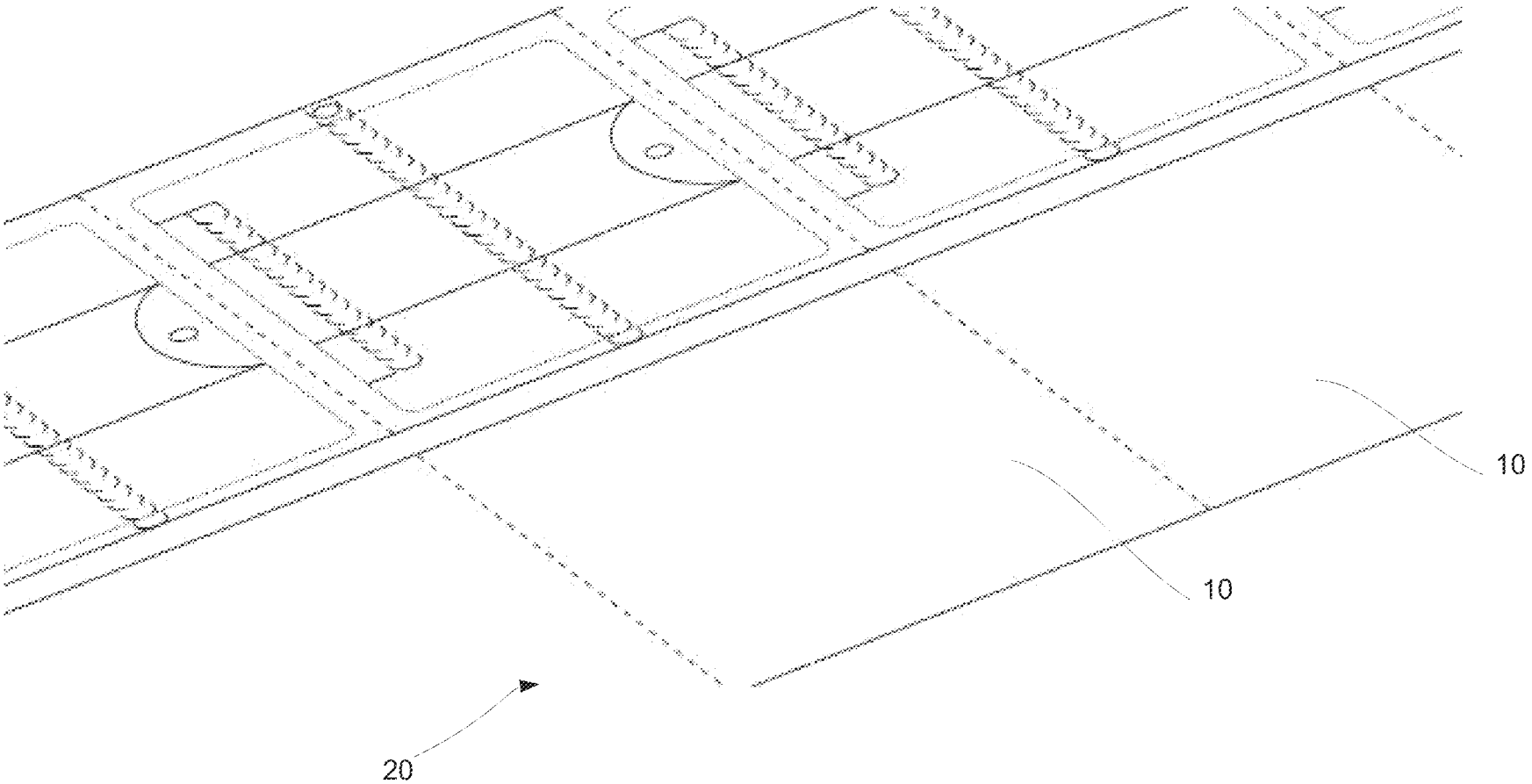

In FIGS. 10-12 are shown advantageous examples of production lines for packages; in FIG. 10 in a flow-pack-method packages 10 are provided directly from a web line is utilized, in FIG. 11 in a side-seal-method packages 10 are provided from a web-line formed pouches with three sides sealed and in FIG. 12 in a thermoforming-method packages 10 are provided from separate lower and upper web-lines, in which stiffer web can be used as top material and more flexible as is common in thermoforming methods generally. In each method the webs for the stiff support part 11 and for the flexible part 12 are attached together at edges by sealing and depending on the method the seals are formed at different locations on the packages 10 thus one package can be opened in different ways depending on the opening points of the package 10.

The method for producing the packages comprises a step of attaching the flexible part 12 and the stiff support part 11 of the package 10 to each other by sealing or adhering them to each other at the edge area and the packages are produced in the line several package blanks sequentially located, possibly also parallel located, in a web-like form, in which the blanks are limited by a tear crease or by a corresponding line. In the production line the creases 15 for the stiff support part 11 are formed and the closure means 13 for opening point 16 of the package 10 is added. Advantageously before the stage of taking the packages 10 to use the packages 10 are located sequentially (and additionally parallel) forming a package web, which web may be wound to a roll, wherein the closure means 13 for the opening points 16 are advantageously located extending from one package 10 to next and forming a continuous structure. Also the objects or contents of the packages 10 can be placed inside the package in the production line.

Figure 13:
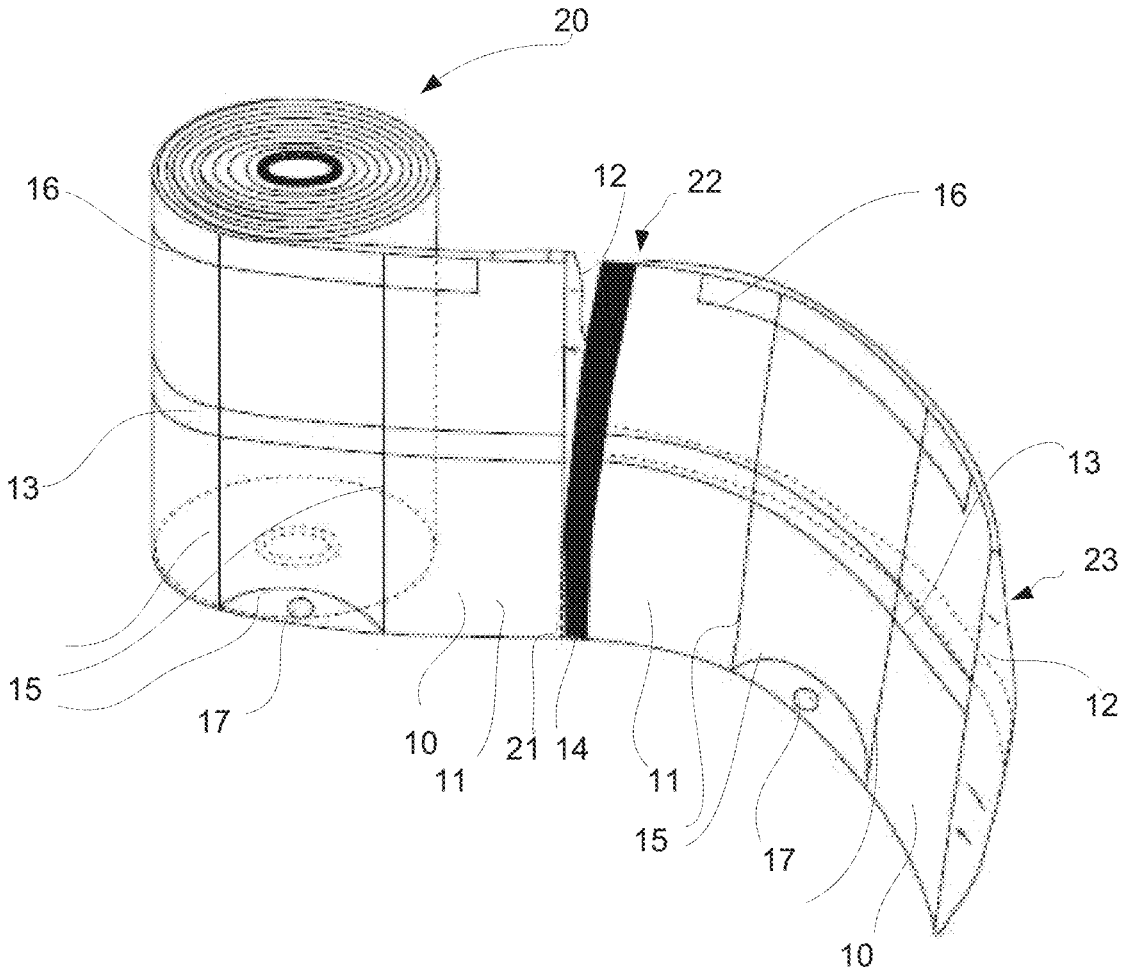
In FIG. 13 is shown schematically an advantageous example of a package roll according to the invention.

In the example of FIG. 13 the package roll 20 comprises several packages 10 and the package roll 20 is formed of a wound web comprising several sequentially located packages 10. Between two successive packages 10 in the package roll a tear line 21 is located and in which closure means 13 extend on the web from one package 10 to next package 10. The package roll 20 is provided with the seal 14 at the location of the tear line 21 between the packages 10. The packages 10 in the package roll 20 provide many different package types, for example many of those presented in the previous figures, for use. In the package roll 20 the packages 10 are closed at one end 22 and the other end 23 is open. When the package roll 20 is used the contents or objects will be put inside the package only after the package 10 has been released from the package roll 20. When the contents or objects are inside the package 10 the open end 22 is closed.

Above only some advantageous examples of the inventions has been described to which examples the invention is not to be narrowly limited and many modifications and alterations are possible within the invention.

The invention claimed is:

1. Package or product comprising a non-opened position and an opened position, in which opened position the package or product comprises at least one expanded space for contents or objects, which at least one expanded space is formed of at least one flexible part, which is a flexible pouch type container part, and in which package or product to the at least one flexible part is attached at least one stiff support part, in which package or product the at least one stiff support part forms in the opened position at least part of wall structure of the package or product, in which opened position the support part of stiff material converts to different position and forms wall structure of the package or product, while the flexible part remains unbroken adapting to the configuration of the stiff support part, which package or product further comprises at least one opening point, in which package or product the at least one flexible part and the at least one stiff support part form the at least one expanded space for the objects or contents and the at least one flexible part is fitted to form the expanded space for the objects or contents adapting to a support structure formed by the at least one stiff support part, and which package or product is self-standing, wherein in non-opened position the package or product is planar and pouch-like and in opened position the package or product is three-dimensional having a substantially depth directional dimension, that the stiff support part comprises creases, cut lines, cut outs and/or tear lines for folding, cutting and/or tearing to open the package or product and to configure the form for the at least one expanded space for the objects or contents, when the stiff material of the stiff support part is bent and the package or product is opened at the stiff support part or when the package or product is opened at the stiff support part, and that the at least one stiff support part forms the supporting structure for the expanded space and the shape of the expanded space in the opened position of the package or product, wherein a package roll is formed of a wound web comprising several sequentially located packages or products.

2. Package or product according to claim 1, wherein the package or product is a pouch formed of two sheets, which are placed one on the other and attached together and which sheets comprises one or more material layers.

3. Package or product according to claim 1, wherein the package or product comprises at the opening point attached closure means, by pulling of which closure means the package or product is openable.

4. Package or product according to claim 3, wherein the closure means is re-closable.

5. Package or product roll according to claim 1, wherein between two successive packages or products a tear line is located and in which package roll closure means extend on the web from one package or product to next package or product.

* * * * *